United States Patent [19]

Wornall et al.

[11] 4,100,651

[45] Jul. 18, 1978

[54] APPARATUS AND METHOD FOR REMOVING AND BLENDING FIBERS FROM A PLURALITY OF FIBER BALES

[75] Inventors: William D. Wornall, Charlotte, N.C.; Nick Valk, Greeneville, Tenn.

[73] Assignee: Aldrich Machine Works, Greenwood, S.C.

[21] Appl. No.: 808,781

[22] Filed: Jun. 22, 1977

[51] Int. Cl.[2] ..... D01G 13/00

[52] U.S. Cl. ..... 19/145.5; 19/81

[58] Field of Search ..... 19/80 R, 81, 145.5; 241/101 A; 56/47, 48

[56] References Cited

U.S. PATENT DOCUMENTS

| | | | |
|---|---|---|---|
| 2,221,262 | 11/1940 | Mims et al. | 19/81 X |
| 3,085,296 | 4/1963 | Meinicke | 19/81 |
| 3,531,831 | 10/1970 | Van Doorn et al. | 19/81 |
| 3,577,599 | 5/1971 | Goldammer et al. | 19/145.5 |
| 3,736,624 | 6/1973 | Alt et al. | 19/80 R |
| 3,806,990 | 4/1974 | Goldammer et al. | 19/145.5 |

FOREIGN PATENT DOCUMENTS

| | | | |
|---|---|---|---|
| 1,504,204 | 10/1967 | France | 19/80 R |
| 580,682 | 8/1958 | Italy | 19/80 R |

*Primary Examiner*—Dorsey Newton

*Attorney, Agent, or Firm*—Bell, Seltzer, Park & Gibson

[57] ABSTRACT

An apparatus and method for obtaining a blend of fibers from a plurality of fiber bales, such as bales of cotton, in which a fiber removing device repeatedly moves along a row of fiber bales while removing fibers from uppermost portions of the bales and depositing the fibers into a fiber collection hopper moving with the fiber removing device along the row of bales. The fiber bales are preferably positioned with the fiber layers in the bales extending longitudinally of the row of bales and oriented in a vertical plane and the fiber removing device removes fibers from all of the exposed layers of the bale to thereby achieve a highly uniform blend of fibers from all of the bales. The fiber bales are supported in a chute which is oriented at an incline with respect to the path of movement of the fiber removing device and the entire row of bales is advanced along the chute to thereby move the upper surfaces of the bales upwardly closer to the fiber removing device. The fiber removing device disclosed herein comprises a rotatable cylindrical drum having a circularly arranged series of fiber grasping jaws around the circumference thereof for grasping fibers from the fiber bales.

12 Claims, 19 Drawing Figures

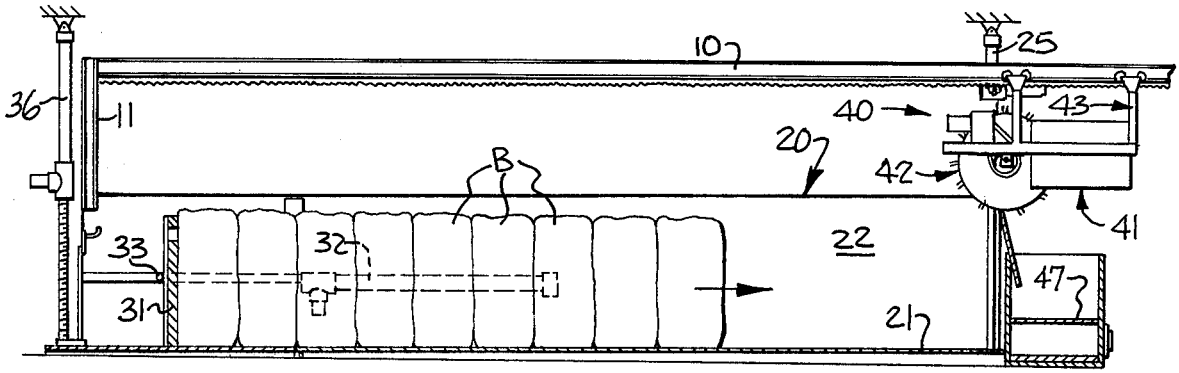
Fig-10
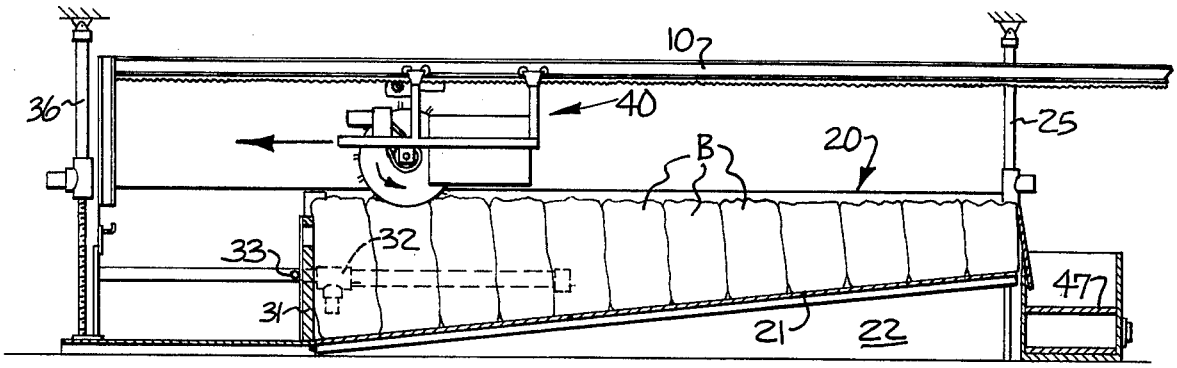
Fig-11
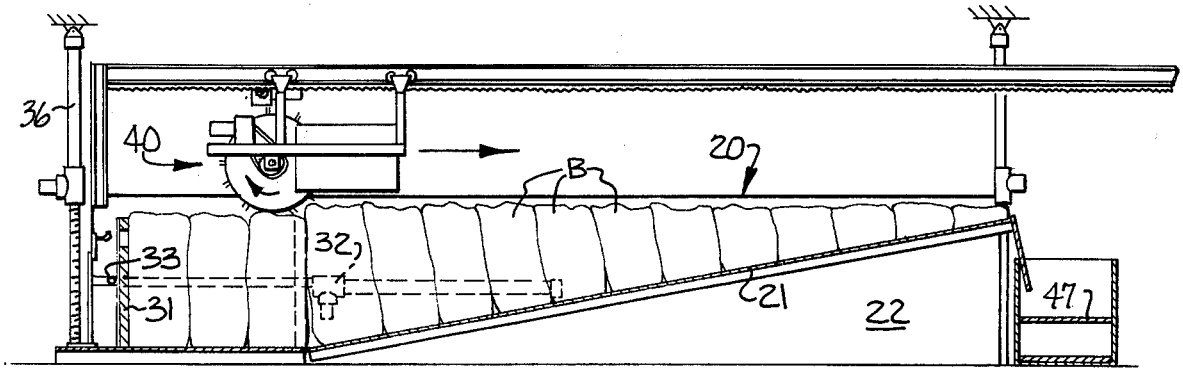
Fig-12
Fig-13
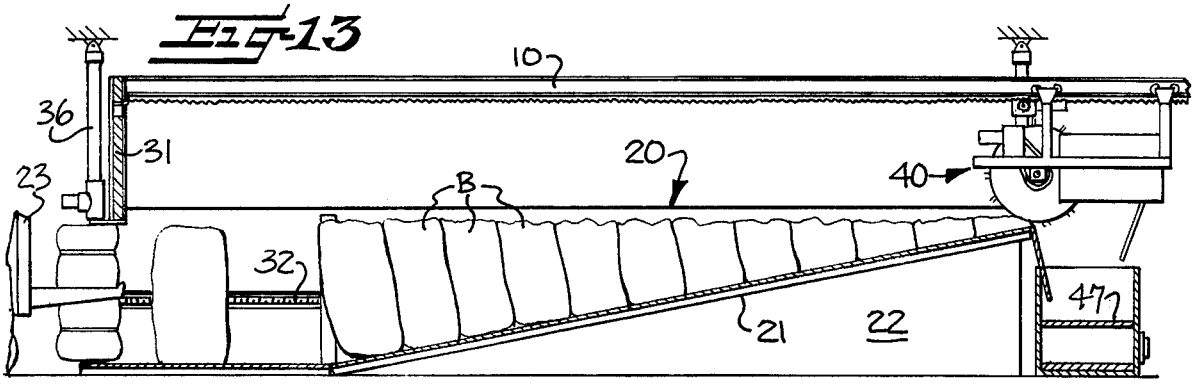

APPARATUS AND METHOD FOR REMOVING AND BLENDING FIBERS FROM A PLURALITY OF FIBER BALES

This invention relates to an apparatus and method for removing fibers from fiber bales, such as bales of cotton, and more particularly to an apparatus and method for removing fibers from a plurality of fiber bales and obtaining a uniform blend of fibers from the bales.

BACKGROUND OF THE INVENTION

Since cotton may vary in quality from bale to bale, it is conventional procedure for mills to blend fibers from a number of different bales in order to obtain a substantially uniform supply of fibers from which to produce yarns.

One common procedure utilized in textile mills for blending of fibers involves laying down a plurality of fiber bales behind each of a series of blending feeder machines and manually pulling portions from the bales and depositing the portions into the respective hoppers of the blending feeders. The delivery ends of the series of blending feeders are interconnected to combine the fibrous output and provide a blend of fibers from all of the bales on the floor. As many as ten to twelve blending feeder machines may be employed in a single bale opening line with from six to eight or more bales being arranged behind each blending feeder.

It will be readily appreciated that this type of fiber blending arrangement requires a considerable amount of floor space in the opening room of a mill and necessitates constant attention from an operator in order to keep the hoppers of the blending feeders filled with fibers. Additionally, the blending feeders are relatively expensive machines and require frequent maintenance and adjustment for proper operation.

Further, even though fibers are taken from a large number of bales, variations in the blend of fibers achieved may still occur because of the manner in which the bales are opened. In this regard, it will be understood that relatively large chunks or layers of fibers are removed from the respective bales and are deposited into the hoppers of the blending feeders. Since the quality of the fibers may vary from layer to layer within a bale due to the way in which the bales are produced in a bale press, as well as varying in quality from bale to bale, removal of an entire fiber layer at a time in the manner described may result in undesirable non-uniformity or variations in the blend of fibers obtained. Also, when blending is performed manually there is a likelihood that the person responsible for keeping the hoppers filled with fibers will not remove fibers from each and every bale on the floor, and this further contributes to non-uniformity in the blend of fibers.

To eliminate the laborious task of manually removing fibers from the bales, various types of automated bale opening machines have been developed. A principle of operation utilized in many commercially available bale opening devices involves moving the fiber bales over a rotating spiked opener roller or belt and removing fibers from the underside of the respective bales. However, it has been determined that removing fibers in this manner results in breaking or rupturing a significant number of the fibers as well as causing undesirable entanglements or neps which may show up as defects in the yarn or fabric produced from the fiber. Further, this type of bale opening device is not well suited to blending fibers from a number of fiber bales. Those devices, such as the "carrousel type" bale opener which do provide for blending from a number of different bales generally require an undesirably large amount of floor space.

A principle of operation utilized in other types of proposed or commercially available bale opening devices, as shown in several recent patents, involves moving a fiber removing device longitudinally above and along a row of fiber bales to remove fibers from the upper surfaces of the bales. For example, in Alt et al. U.S. Pat. No. 3,736,624, a rotating fiber opening roller is reciprocated across the tops of a series of stationary bales to remove layers of fibers therefrom. Other devices, such as those shown in Goldammer U.S. Pat. No. 3,443,285, Van Doorn U.S. Pat. No. 3,531,831, and in Keller U.S. Pat. Nos. 3,777,908, 3,951,282 and 3,986,623 employ grippers which are movable relative to the bales and which grasp and remove masses of fibers from the respective bales. In the devices shown in the Goldammer and Keller patents, the grippers take relatively large masses of fibers from a bale with each grasp. These devices remove fibers from the bales layer by layer in a manner similar in many respects to the previously noted manual technique for opening fiber bales, and thus suffer many of the same disadvantages with respect to obtaining a desirable blend of fibers from the bales. These devices also require the use of a series of relatively expensive blending feeder machines, as in the above-described manual technique, and thus also require a large amount of floor space in the opening room.

The Van Doorn patent discloses a plucker unit which moves along a series of fiber bales and removes smaller masses of fibers from the bales, employs a series of chains carrying plucking members for removing the fibers, as well as a complicated assembly of numerous other moving parts, all of which are subject to wear and to fouling by the fibers and lint produced incident to the plucking operation. The Van Doorn device requires a massive and complicated system for supporting the plucker unit above the series of bales and for gradually lowering the same as the bales are reduced in height, with the device being thus limited to batchwise operation on a plurality of bales. In order to operate in a substantially continuous manner, it is necessary to provide extra bins alongside the plucker unit for holding extra rows of bales. Further, the construction and arrangement of the plucking members of the Van Doorn device has a tendency to undesirably compact the fibers of the bales as the plucking members are moved downwardly into engagement with the bales during operation of the device.

With the foregoing in mind it is an important object of the present invention to provide a method and apparatus for removing and blending fibers from fiber bales which overcomes the disadvantages and limitations of the prior manual and automated bale opening practices.

It is another important object of this invention to provide a method and apparatus for removing and blending fibers from a plurality of fiber bales and wherein a highly uniform blend of fibers from the respective bales is obtained.

It is another object of the present invention to provide a method and apparatus for opening fiber bales which accounts for variations in fiber properties from bale to bale and also within each bale so as to thereby provide a highly uniform blend of fibers from the respective bales.

It is a further object of the invention to provide a method and apparatus of the type described in which the fibers removed from the bales are so well blended that some of the subsequent processing steps normally required for further blending may be eliminated if desired.

It is a further object of the invention to provide a method and apparatus of the type described wherein the uniform blend of fibers is accomplished with less equipment and with more simplified apparatus than in the prior bale opening devices.

It is still another object of the present invention to provide a method and apparatus of the type described wherein the fibers removed from the bales are in a much more opened state to thus eliminate the need for significant additional opening of the fibers prior to further processing.

SUMMARY OF THE INVENTION

These and other objects of the invention are achieved by providing an apparatus and method in which a fiber removing device moves along a row of bales while engaging uppermost portions of the bales and removing fibers therefrom during movement of the fiber removing device along the row of bales, and wherein a fiber collection hopper is mounted for movement with the fiber removing device along the row of bales for receiving and collecting fibers removed from the bales by the fiber removing device. The fiber removing device moves repeatedly along the row of fiber bales to obtain a mix of fibers from all of the bales in the row.

In the preferred embodiment of the invention illustrated herein the fiber removing device is adapted to remove relatively small bunches of fibers from the bales at a plurality of longitudinally spaced transversely extending locations along the respective bales during movement of the fiber removing device along the row of bales. By taking only relatively small amounts of fibers at a time from each of a series of bales, the fiber removing device obtains a highly uniform blend of fibers from the bales. The uniformity of blend achieved is sufficient to eliminate the need for a series of blending feeder machines for fiber blending purposes.

Preferably, the bales are arranged in a row with the fiber layers thereof extending longitudinally of the row of bales and oriented in a vertical plane, and with each grasp the fiber removing device removes fibers from the many layers forming each bale. This achieves a much more uniform blend of fibers from the respective bales, compensating not only for variations in fiber quality and characteristics from bale to bale, but also taking into account that the fibers may vary from layer to layer within a bale due to the way in which the bales are produced in a bale press. The resulting increased uniformity of blend is sufficient in most instances to eliminate a significant number of the subsequent doublings conventionally performed for blending purposes during the picking, carding and drawing operations.

The apparatus of the present invention as illustrated herein includes an elongate bale support adapted for supporting a series of bales in a row in consecutively arranged abutting relation. An elongate trackway is provided extending parallel to the bale support and a carriage is mounted for translational movement along the trackway adjacent to the bale support and the respective fiber bales thereon. A cylindrical drum is supported by the carriage overlying the bale support and the fiber bales and is mounted for rotational movement about a horizontal axis transverse to the direction of translational movement of the carriage. A plurality of pluckers extend across the width of the cylindrical drum at circumferentially spaced locations around the periphery thereof. As the drum is moved longitudinally along the trackway on the carriage, it is also rotated so as to bring the pluckers into engagement with uppermost portions of the respective bales at spaced apart locations on the bales as the respective pluckers reach the lowermost position during rotation of the drum. The pluckers are adapted to open and close in timed relation with the rotational and translational movement of the drum so as to grasp bunches of fibers from the bales and subsequently release the fibers. A fiber collection hopper may be suitably provided on the carriage alongside the rotating drum and positioned for receiving and collecting the fibers removed from the bales by the pluckers.

During operation of the apparatus, the drum is moved along the trackway in a reciprocating manner from one end of the row of bales to the other while removing fibers from the bales and depositing the fibers into the fiber collection hopper. Periodically, the drum and fiber collection hopper stop at one end of the row of bales with the hopper positioned overlying an extended apron or other suitable conveyor serving a fiber processing machine such as a cleaning machine, and a door provided in the fiber collection hopper is opened to release the collected fibers and deposit them on the apron.

The pluckers provided on the drum are preferably in the form of cooperating pairs of elongate segmental bars arranged end to end across the axial extent of the drum. The segmental bars are mounted for movement between a radially extended position with the cooperating bars being spread apart from one another and adapted to receive fibers therebetween, and to a radially retracted position with the cooperating bars closed toward one another and adapted to graspingly retain the fibers therebetween.

In order to compensate for the diminishing height of the bales as fibers are removed from the uppermost portions thereof, the bales are supported in such a manner as to permit moving the bales and bringing the upper surfaces thereof closer to the path of movement of the drum. According to a preferred embodiment of the invention, the elongate bale support comprises an inclined chute which supports the bale at an incline relative to the path of movement of the drum. The series of bales in the chute is pushed along the chute toward the elevated end thereof and the upper surfaces of all the bales are thereby elevated so that the upper surfaces remain substantially the same distance below the longitudinally movable fiber removing device.

The chute, more particularly, is of a length adapted for accommodating a plurality of successively arranged abutting fiber bales thereon, and is provided with a flat lower wall having a relatively smooth surface to facilitate sliding of the bales thereacross and opposing side walls spaced apart to accommodate the bales therebetween and serving to guide the bales along the chute while restraining expansion of the fiber bales as the bales are pushed along the chute.

A pusher plate is provided at the input end of the chute with means associated with the pusher plate for longitudinally moving the same between an inoperative position spaced from the input end of the chute a distance sufficient to accommodate the positioning of one or more fresh fiber bales therebetween, and to an operative position with the pusher plate received within the chute. The pusher plate is used to advance the bales along the chute, as well as to periodically push the fresh fiber bales into position adjacent the other fiber bales in the chute.

The output or discharge end of the chute is supported in elevated relation by an adjustable support means which is operable to permit lowering the output end of the chute at certain times to thereby position the chute substantially parallel to the floor. The chute may also optionally be provided with adjustable support means at the input end thereof for adjustably raising the input end of the chute at certain times to thereby position the chute in an elevated horizontal orientation.

The bale support device utilized in this invention is of relatively simple construction as compared to some of the arrangements previously proposed for supporting fiber bales while fibers are removed therefrom. Further, the bale supporting device of this invention is characterized by considerable versatility in the way it can be used, being equally suited for use with small or large lots of fiber bales on either a continuous or batchwise basis.

BRIEF DESCRIPTION OF THE DRAWINGS

Further objects, features and advantages of the invention will become apparent from the detailed description which follows, when taken in connection with the accompanying drawings, in which

FIG. 10 is a side view of the bale support chute similar to FIG. 2, and illustrating the method of initially loading the chute with fiber bales with the lower wall of the chute in the lowered horizontal position;

FIG. 11 is a side view similar to FIG. 10 and showing a further step in the initial loading of the chute with fiber bales in which the discharge end of the lower wall of the chute is raised while the bale plucking drum is operated to remove fibers from the upper surfaces of the bales;

FIG. 12 is another side view of the bale support chute showing the normal method of operation after the initial loading of the chute with bales and wherein three additional fiber bales have been positioned at the input end of the chute;

FIG. 13 is a side view similar to FIG. 12 but showing how fresh fiber bales are loaded onto the input end of the chute in order to replenish the supply of fiber bales on the chute;

DESCRIPTION OF THE PREFERRED EMBODIMENTS

Referring now more particularly to the drawings for a better understanding of the invention, a pair of elongate I-beams 10 are mounted in horizontally disposed parallel relation above the floor in the opening room of a textile mill, with the beams 10 collectively defining an elongate elevated trackway. The beams 10 may be supported above floor level by upright support posts (not shown) or, if desired, in other suitable ways, as for example suspended from a ceiling or other overhead structure.

Figure 1:
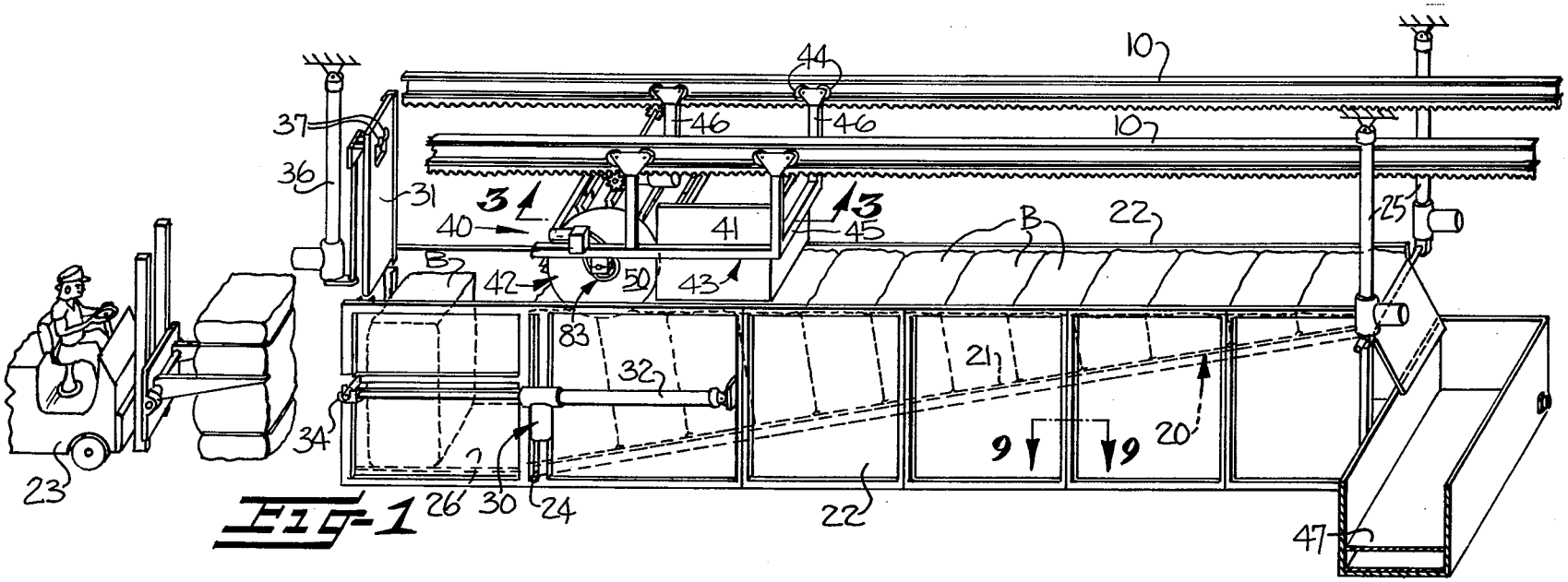
FIG. 1 is a side perspective view of the apparatus according to a preferred embodiment of the invention, showing the inclined bale support chute with a plurality of fiber bales thereon, the elongate elevated trackway, the bale plucker drum, and the fiber collection hopper, and showing a fiber bale being loaded at the input end of the bale support chute.
Figure 2:
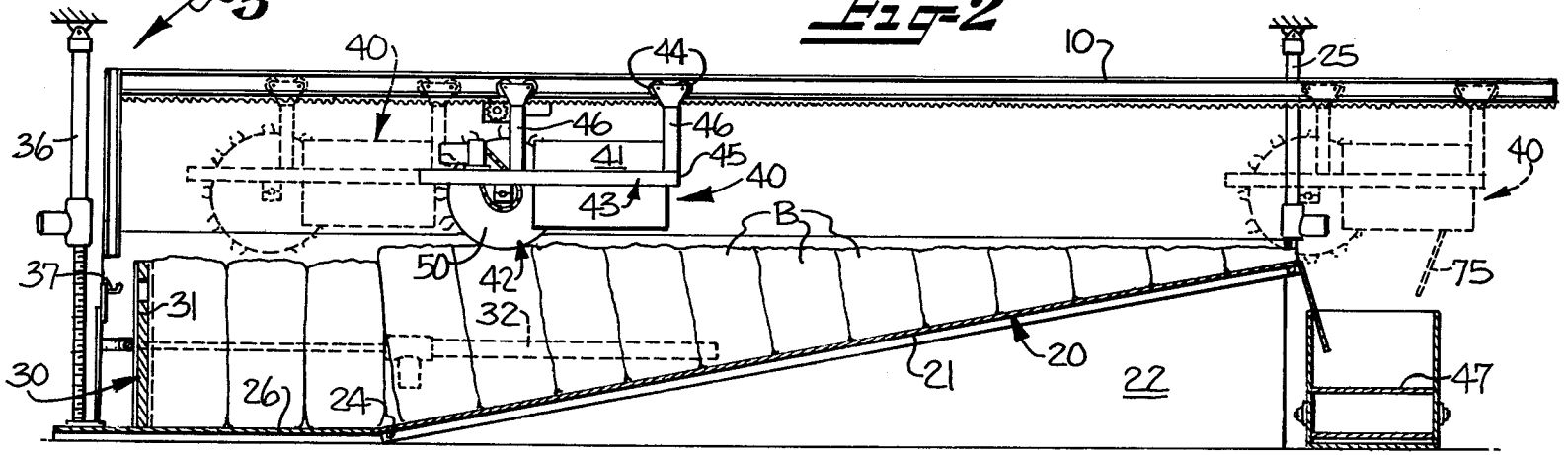
FIG. 2 is a side elevational view of the apparatus, partly in cross-section, and illustrating the path of movement of the bale plucker drum and fiber collection hopper along the row of bales.

Beneath the trackway is an elongate bale support device adapted for supporting a plurality of successively arranged fiber bales thereon. In the preferred form of the invention illustrated, the bale support device is in the form of an elongate chute, generally indicated by the reference character 20. The length of the chute may be selected as desired, depending upon the requirements and space limitations of the particular installation. Generally, however, the chute 20 is of a length sufficient to accommodate at least five and preferably ten to fifteen consecutively arranged fiber bales B. As illustrated, the elongate chute includes an elongate generally planar lower wall 21 adapted for supporting the row of fiber bales thereon and opposing side walls 22 extending along opposite sides of the lower wall 21 and serving to confine the bales B within the chute and to assist in guiding and maintaining the bales in properly aligned abutting relation. The lower wall 21 is vertically movable relative to the fixed side walls 22 for purposes hereinafter described, and as illustrated in FIGS. 1 and 2 the output end of the lower wall 21 shown in the right-hand side of FIGS. 1 and 2 is supported in raised relation above the input end thereof so that the lower wall 21 is positioned in an inclined orientation relative to the overlying trackway. At the input end of the chute a pusher assembly, generally indicated at 30, engages the endmost fiber bale to advance the bales along the chute and thereby move the bales upwardly to maintain the bales in position for engagement by a fiber removing device as described more fully hereinafter.

The fiber removing device, generally designated by the reference character 40 is mounted for translational movement along the trackway above the upper surface of the row of fiber bales while engaging uppermost portions of the respective bales and removing fibers therefrom as the fiber removing device moves along the trackway. A fiber collection hopper, generally designated by the reference number 41, is associated with the fiber removing device 40 and is mounted for movement therewith along the row of bales for receiving and collecting the fibers removed from the bales by the fiber removing device.

More particularly, in the preferred form of the invention illustrated, the fiber removing device 40 may be characterized as a rotatable plucking means which includes a cylindrical drum 42 having a circularly arranged series of jaws extending axially across the drum at spaced locations around the periphery of the drum. The drum 42 is mounted for rotational movement about a horizontal axis extending above the upper surface of the bales and in a direction transverse to the longitudinal direction of the row of bales. The drum 42 is supported above the row of bales from a carriage 43 which, in turn, is suspended from the I-beams 10 of the trackway and adapted for movement therealong on wheel assemblies or rollers 44. The drum 42 is thus mounted for translational movement along the row of bales with movement of the carriage 43, and for simultaneous rotational movement about the axis of the cylindrical drum. It will be seen that lowermost portions of the drum are received between upper portions of the side walls 22 of chute 20 as drum 42 moves along the row of bales.

Carriage 43, more particularly, includes a rectangular frame 45 to which both the fiber collection hopper 41 and the drum 42 are mounted. Vertical support members 46 extend upwardly from the frame 45 and collectively serve to suspend the frame, drum, and hopper from the I-beams 10. The wheel assemblies 44 carried at the upper ends of the support members 46, engage the lower flanges of the I-beams 10 and allow the frame 45, drum 42, and hopper 41 to be translationally moved as a unit along the trackway.

The series of jaws carried by the cylindrical drum 42 are adapted to open and close in timed relation with the rotational movement of the drum relative to the bales so as to thereby successively grasp bunches of fibers from the bales at longitudinally spaced apart locations on the bales upon rotation of the drum and to thereafter release the bunches of fibers into the fiber collection hopper moving alongside the drum.

Figure 3:
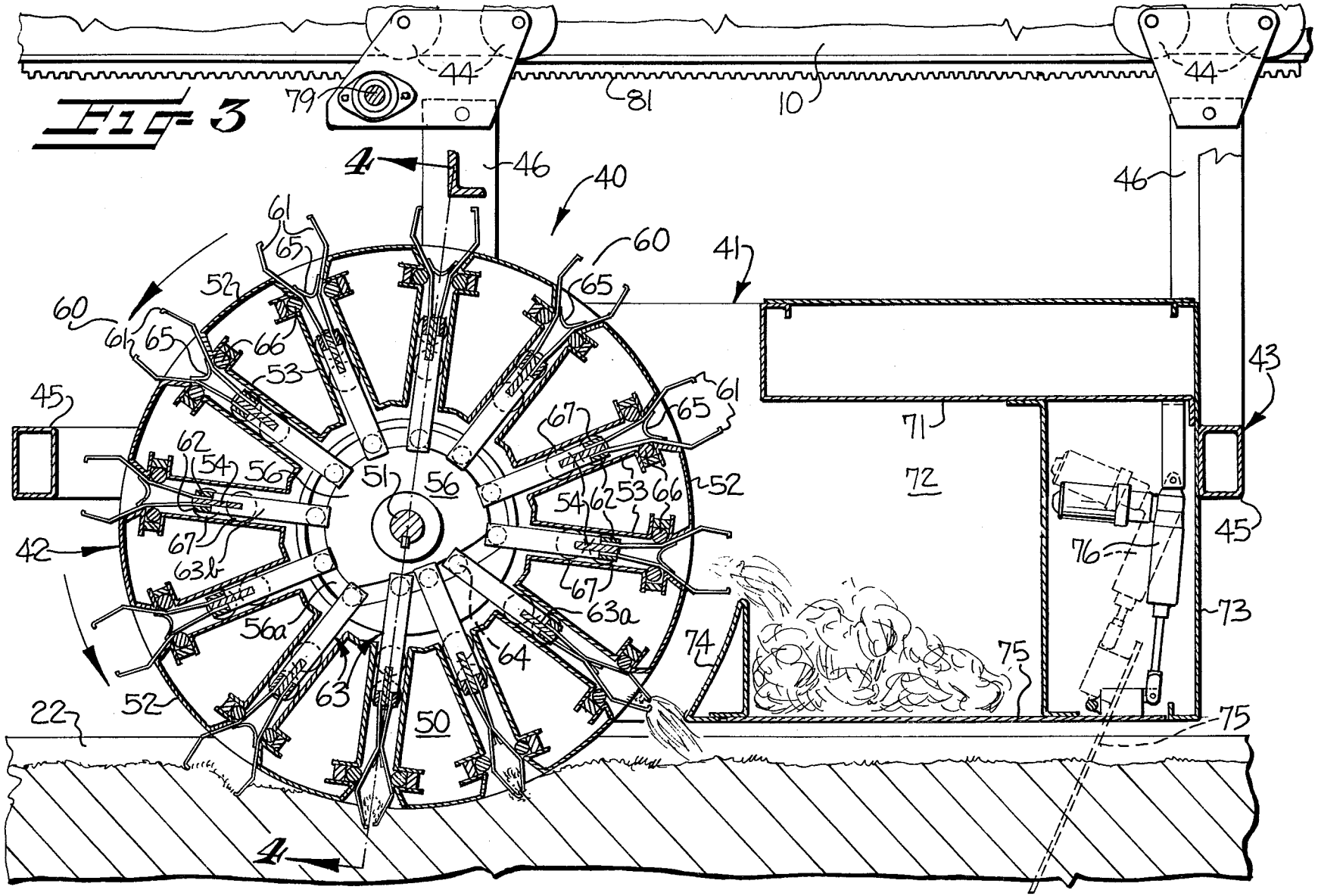
FIG. 3 is a cross-sectional view of the cylindrical bale plucker drum and fiber collection hopper taken along the line 3—3 of FIG. 1.
Figure 4:
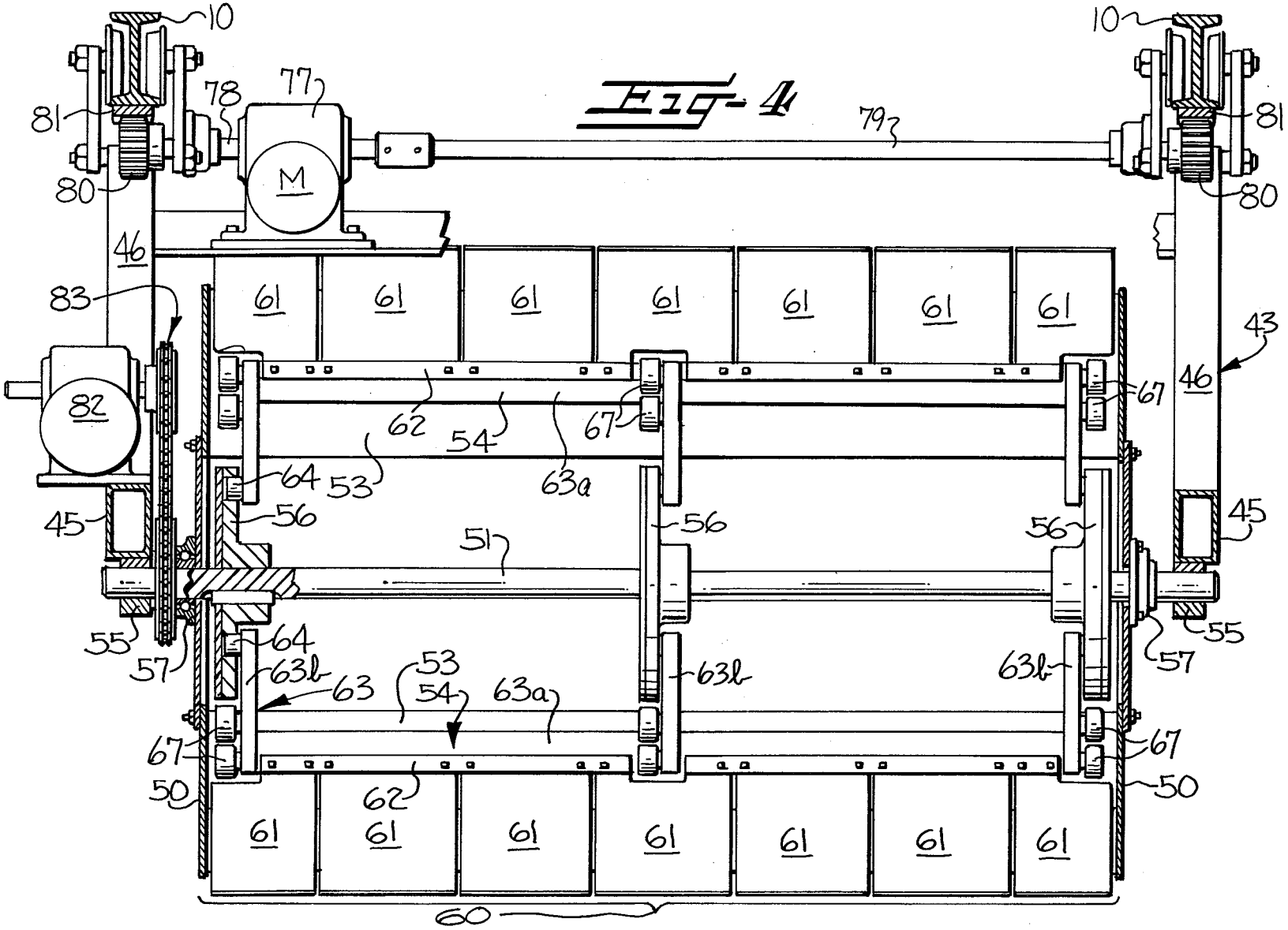
FIG. 4 is a longitudinal cross-sectional view of the plucker drum taken along the line 4—4 of FIG. 3.

Referring in more detail to the construction of the drum 42, as best illustrated in FIGS. 3 and 4, the drum has opposing circular end walls 50 with a central axle or shaft 51 extending therethrough. The outer periphery of the drum is defined by a series of arcuate segmental outer wall portions 52 which are secured to the end walls 50 in spaced relation from one another leaving spaced apart axially extending gaps or openings along the periphery of the drum between adjacent wall portions 52. Each outer wall portion 52 has a cooperating inner wall portion 53 of generally V-shaped cross-section. The sides of adjacent inner wall portions 53 are spaced from one another and define radially extending channels therebetween across the axial dimension of the drum to accommodate respective plucker assemblies 54 therein. The plucker assemblies 54 are adapted for radial movement in the respective channels as described below to actuate the opening and closing of the fiber grasping jaws.

The central shaft or axle 51 of drum 42 does not rotate, but is fixedly mounted to the carriage 43 by support blocks 55 and has a plurality of closed cams 56 mounted thereon interiorly of the drum. The drum rotates about the stationary axle 51 on suitable bearings 57 (FIG. 4) carried by the end walls 50 of the drum.

Each plucker assembly 54 includes a pair of plucker bars 60 which are mounted in opposing cooperating relation and adapted to be moved toward and away from one another to grasp fibers therebetween. While the plucker bars 60 may, if desired, be formed of elongate continuous members of a length corresponding to the axial dimension of the drum, preferably, and as illustrated, the plucker bars 60 are segmental and are comprised of sets of relatively short bar segments 61 (FIG. 4) arranged end-to-end in a row across the axial extent of the drum. The bar segments 61 are formed of spring steel or other suitable strong but resilient material and are mounted to a lifting frame 63 located inside the radially extending channels in drum 42.

The lifting frame 63 includes a cross-member **63*a* to which the bar segments 61 are mounted and are secured in place by overlying bars 62. A plurality of radial members 63*b*, corresponding in number to the number of cams 56 extend radially inwardly from the cross member 63*a*, with the radially innermost ends of the respective radial members having cam followers 64 which ride in the closed grooves 56*a* provided in the respective cams 56**.

As best seen in FIG. 3, during rotation of the drum 42, the lifting frames 63 of the respective plucker assemblies 54 cause the plucker bars 60 to be successively moved radially outwardly and inwardly in the radial channels in drum 42 between a fully extended position with the cooperating pairs of plucker bars 60 open and outstretched, and a retracted position with the cooperating plucker bars 60 pushed together and closed for grasping fibers from the bales, and again to an extended open position for releasing the fibers. It will be seen that the previously mentioned fiber grasping jaws are defined by the outermost end portions of the respective plucker bars. Preferably, and as illustrated, the outermost end portions of the respective plucker bars are provided with relatively small inwardly facing lips or flanges **60*a*** which, when closed, lie one inside the other to provide an enhanced snubbing action for graspingly retaining the fibers.

Since the bar segments 61 which comprise the plucker bars 60 are mounted to a common cross member 63*a* they move inwardly and outwardly simultaneously as a unit. However, due to the segmental construction, each cooperating pair of the bar segments 61 resiliently flexes independently of the other cooperating pairs in the row to independently accommodate and grasp bunches of fibers regardless of size to thereby insure a more uniform removal of fibers across the bales. Thus a relatively large clump of fibers between a given pair of segmental bars will not prevent other pairs of segmental bars in the row from grasping a smaller size clump of fibers, as might otherwise occur if the bars were not of segmental form.

A flexible rubberized seal 65 is fastened to the interior surface of the cooperating plucker bars 60 and serves to prevent fibers, lint and dust from entering the interior of the drum during operation and movement thereof, while replaceable wear rollers 66, carried by the inner segmental wall portions 53 of the drum, engage the outside surfaces of the plucker bars 60 and serve for camming the plucker bars toward one another upon retraction of the lifting frame 63. Since the plucker bars 60 are always in contact with the wear rollers 66, the rollers also serve to provide an effective seal against the entry of fibers and dust inside the mechanism. Rollers 67 carried by the lifting frames 63 engage the opposing side walls of the inner wall portions 53 which define the radially extending channels in the drum and thereby guide the respective lifting frames 63 during the radial movement thereof in the radial channels in the drum.

Referring now to FIG. 3, the fiber collection hopper 41 is mounted on the carriage 43 alongside the drum 42 and is positioned for receiving and collecting the bunches of fibers from the drum during movement of the drum and the hopper along the row of bales. As illustrated, the hopper 41 is provided with a fixed upper wall 71, opposing side walls 72 and rear wall 73. On the front side of the hopper facing the drum, a partition 74 is provided in the lower portion thereof with the upper portion of this side of the hopper being open for receiving fibers from the drum. The underside of the hopper is provided with movable door means to permit dumping the collected fibers from the hopper. As illustrated, the door means comprises a hinged lower wall 75 which is normally maintained in a closed position to retain the fibers in the hopper but which may be opened when it is desired to discharge fibers from the hopper. A suitable actuator, such as the electrically operated piston 76 shown in FIG. 3, is pivotally connected to the lower wall 75 and serves for effecting opening and closing of the lower wall to thereby discharge fibers from the hopper. If desired, a self-contained dust collection system may be provided within the hopper to assist in controlling dust and lint during operation of the apparatus.

Referring now more particularly to the manner of operation of the fiber removing device and fiber collection hopper, the carriage 43, cylindrical drum 42, and associated fiber collection hopper 41 are reciprocated back and forth along the trackway above the row of bales by a reversible electric motor 77 (FIG. 4) which, through shafts 78 and 79, drives a pair of pinion gears 80 cooperating with respective rack gears 81 carried by the underside of each of the elongate beams 10.

In the embodiment of the invention illustrated in the drawings, the drum 42 and associated hopper 41 are moved along the trackway during the plucking stroke in a direction toward the end of the chute shown at the left of FIGS. 1 and 2. At the same time, a drive motor 82, operating through a suitable drive means such as the sprocket and chain assembly 83, rotates drum 42 in a counterclockwise direction as viewed in FIGS. 1 and 2. The rate of rotation of drum 42 is preferably correlated with the rate of translational movement of the carriage along the trackway so that the periphery of the drum substantially rolls along the upper surface of the bales. However, some adjustment of the relative rates of rotational speed and translational speed as well as adjustment of the orientation of cams 56 may be made as needed depending upon the condition of the bales and kind of fiber to thereby adjust the amount of fibers removed from the bales by the pluckers.

As the periphery of the drum moves across the upper surface of the bales, the rolling movement of the drum brings the plucker bars 60, in fully extended and opened position, successively into engagement with the uppermost portions of the fiber bales. As the respective plucker bars 60 approach the lowermost point in their path of rotational movement (FIG. 3) and while in engagement with the bale, the plucker bars are retracted and closed to grasp bunches of fibers therebetween across substantially the entire transverse dimension of the bale. Meanwhile, the segmental outer wall portions 52 of the drum located between adjacent pairs of plucker bars 60, bear against the upper surface of the bales to assist the plucker bars in pulling discrete bunches of fibers free from the bales. As the plucker bars 60 continue their movement and begin to move upwardly in their circular path of travel, the grasped fibers are pulled free from the bale. Then, as the plucker bars continue their upward rotational movement, the cams 56 cause the plucker bars 60 to be extended from the drum, opening the jaws and releasing the fibers into the fiber collection hopper 41. The plucker bars 60 remain in the extended open position as they continue their rotational movement until they are again brought into engagement with the fiber bale.

It will thus be seen that the fibers are removed from the bales at longitudinally spaced locations along the bales and across substantially the entire transverse dimension of the bale. Preferably, the bales are positioned in the chute on their ends with the layers or strata of fibers L (FIGS. 7 and 8) which are produced during formation of the bale in the bale press, oriented in a vertical plane extending longitudinally of the row of bales. By this arrangement, the plucker bars 60 remove fibers from the entire cross-section of the bale, i.e., from each of the layers or strata in the bale, to obtain a representative blend of fibers from the entire bale with each grasp.

The arrival of the carriage at the far end of the trackway is sensed by a switch, which through suitable electrical connections, not illustrated, causes the electric motor 77 to stop the translational movement of the carriage along the trackway. Motor 82 however, continues to rotate the drum for a short period of time after the translational movement of the drum 42 has stopped at the end of the row of bales so that the fibers already grasped by the lowermost plucker bars 60 may be released into the hopper 41. This also serves to insure that the plucker bars are indexed to engage different longitudinally spaced locations on the bales during the next plucking stroke of the drum. Motors 77 and 82 are then operated in the reverse direction to return the drum 42 and the hopper 41 to the opposite end of the trackway.

Since the direction of rotation of the drum during the return stroke is opposite from the direction of rotation during the plucking stroke, the drum again rolls along the upper surface of the bales. During this return stroke of the drum the plucker bars 60 are in a retracted closed position as they engage the uppermost portions of the bales and are moved from a closed retracted position to an open extended position while in engagement with the bale. Therefore the drum moves along the bale without grasping fibers from the bale.

Upon the arrival of the carriage 43 at the discharge end of the chute (shown in the right-hand portion of FIG. 2), the carriage is stopped in the position shown in dotted lines in FIG. 2 with the hopper 41 overlying a suitable fiber receptacle such as an extended apron conveyor 47 of a fiber cleaning machine. The lower wall or door 75 of the hopper is then opened and the load of collected fibers is deposited onto the apron conveyor 47. As soon as the fibers are released and the door 75 is again closed, the apparatus is again ready for another pass along the row of bales. The hopper 41 may either be emptied after each pass along the row of bales or, if desired, it may be periodically emptied after a plurality of successive passes along the row of bales.

As fibers are removed from uppermost portions of the bales, it is necessary to elevate the bales in order to maintain the upper surfaces thereof in engagement with the drum. This may be accomplished in a number of ways. In accordance with the preferred embodiment of the invention illustrated, chute 20 is designed to accomplish this function. However, other types of bale support devices besides the chute 20 illustrated herein may be suitably employed in conjunction with the fiber removing device of this invention. For example, in some installations one may wish to use an inclined endless conveyor rather than the chute 20. It is contemplated that conveyors or other bale support devices could be suitably employed with the fiber removing device of this invention in certain specialized installations.

Figure 9:
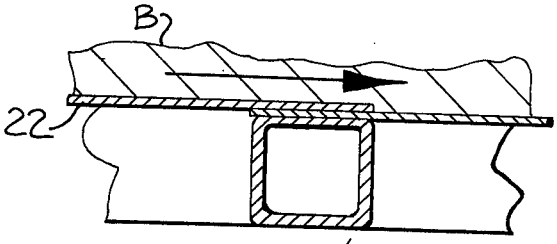
FIG. 9 is a cross-sectional view taken along the line 9—9 of FIG. 1 and showing details of the construction of the side wall of the bale support chute.

Referring more particularly to the details of chute 20, it will be seen in FIGS. 1 and 2 that the bales B are supported in abutting relation to one another on the lower wall 21 of the chute. The fiber bales are advanced along the inclined chute by a pusher assembly 30 from the input end of the chute, shown at the left-hand side of FIGS. 1 and 2, to the discharge or output end of the chute seen at the right-hand side of FIGS. 1 and 2. Preferably, the panels which define the side walls 22 of the chute are overlapped in the manner shown in FIG. 9 to avoid presenting any obstructions to the movement of the bales along the chute. As illustrated, the pusher assembly 30 includes a pusher plate 31 which engages and pushes the endmost bale of the row of bales and causes the entire series of bales to be advanced along the inclined chute thereby causing the uppermost portions of the bales to be moved upwardly closer to the drum. The pusher plate 31 is moved by suitable means such as electrically driven jack screws 32.

Normally, four to five passes of the drum is needed before the entire upper surface of the bales is reduced in height, since as previously noted, the fibers are removed from the bales at longitudinally spaced locations during each successive pass of the drum 42. Thus, the jack screws 32 may be operated intermittently for a short period of time after every four to five passes of the drum. However, if desired, the jack screws 32 may be operated continuously at a slow rate of speed during the time that the carriage 43 is moving along the bales. This continuously repositions the previously plucked areas of the bales and thus assists in insuring that different locations on the bale are plucked in each successive pass of the drum.

Figure 5:
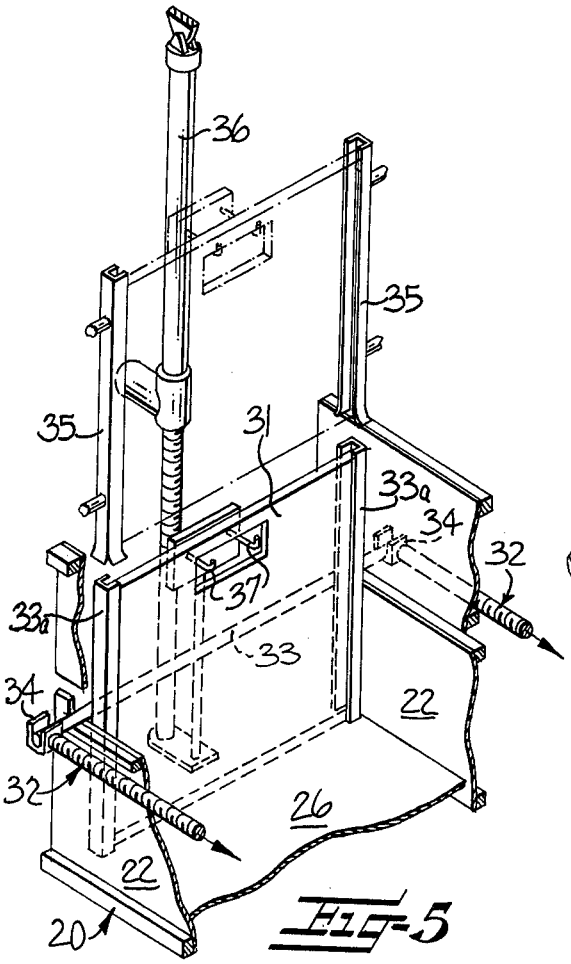
FIG. 5 is a fragmentary perspective view of the input end of the bale support chute as viewed from the arrow 5 in FIG. 2 and showing the details of the pusher assembly used for advancing the bales along the chute.
Figure 6:
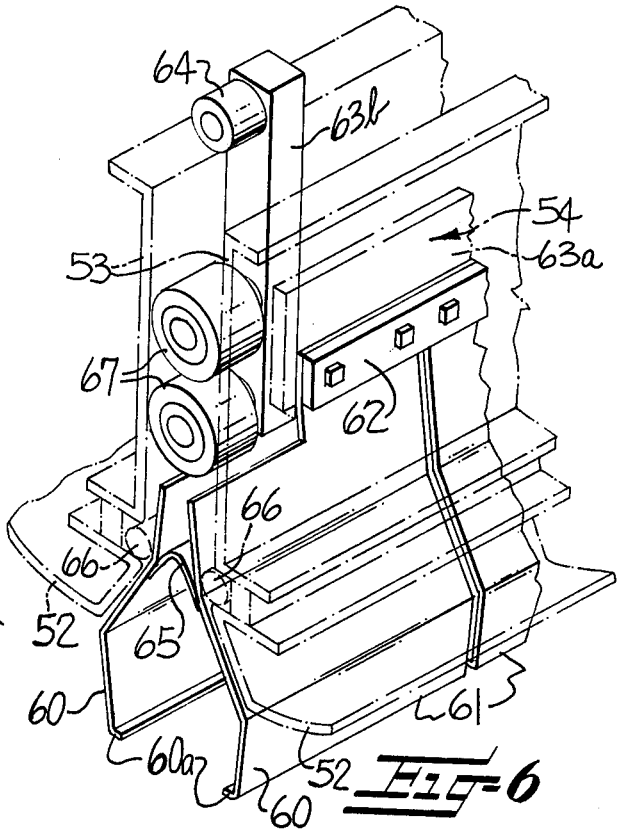
FIG. 6 is a fragmentary perspective view of a portion of the cylindrical plucker drum showing details of one of the plucker assemblies.

Referring in more detail to the pusher assembly 30, as best seen in FIG. 5, the pusher plate 31 is not attached to the chute but rather is freely movable between the opposing side walls 22 of the chute. A shaft 33, carried by mounting blocks 34 at the ends of the jack screws 32, extends across the width of the chute with U-shaped channel members **33*a* being attached to the shaft 33 and receiving opposite sides of the pusher plate 31 therein, thus causing the pusher plate to be moved inwardly into the chute upon operation of the jack screws 32**.

In order to provide access to the input end of the chute for positioning fresh fiber bales therein, the pusher plate 31 may be moved to an inoperative position. In this regard, it will be noted that a pair of U-shaped trackways 35 are provided above the side walls 22 of the chute adjacent the input end thereof. When the pusher plate 31 is positioned in the outermost position adjacent the input end of the chute, the pusher plate may be raised upwardly out of channel members **33*a* and into the trackways 35, thus positioned out of the way above the chute to thereby provide free access to the input end of the chute for positioning fiber bales therein. A jack screw 36 is pivotally mounted from above and provided with hooks 37 adjacent the lower end thereof which may be positioned to engage a suitably located opening in the pusher plate 31 for effecting raising of the pusher plate as illustrated in FIG. 5. The shaft 33 with channel members 33*a* may then be removed from the mounting blocks 34 at the ends of the jack screws 32** to permit loading of fiber bales into the chute.

Figure 7:
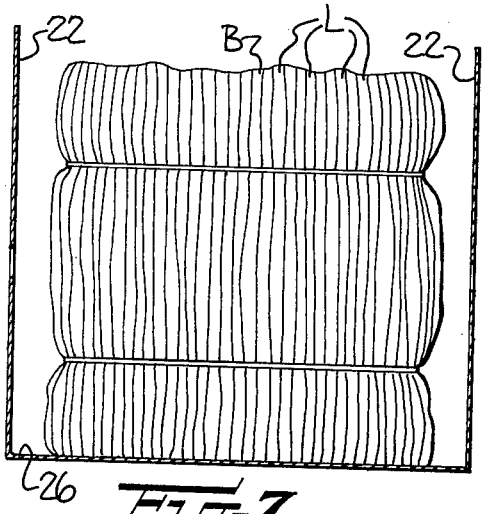
FIG. 7 is an elevational view looking into the input end of the bale support chute and showing a fiber bale positioned in the chute prior to removal of the last two bale ties.
Figure 8:
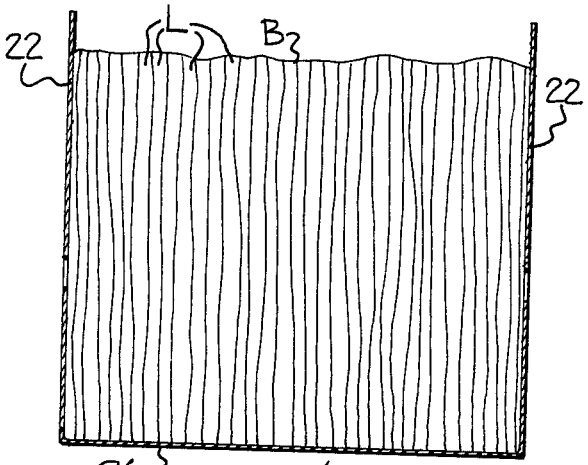
FIG. 8 is a view similar to FIG. 7 but showing the appearance of the bale after removal of the bale ties.

As previously noted, the bales are preferably positioned in the chute in an upright orientation resting on one end thereof with the fiber layers L (FIGS. 7 and 8) in the bales thus oriented in a vertical plane extending longitudinally of the row of bales. As shown in FIG. 7, the bale coverings and all but two of the bale ties are removed prior to positioning the bale in the chute. It will be noted that the side walls 22 of the chute are spaced apart a distance somewhat greater than the width dimension of the bale to facilitate readily positioning the bale in the chute by a fork-lift truck 23 (FIG. 1) equipped with pincers, or by other suitable means. Once the bale is suitably positioned in the chute, the remaining two ties are removed and the bale quickly blossoms and expands into engagement with the side walls of the chute to completely fill the chute (FIG. 8).

As noted earlier, the lower wall 21 of chute 20 is vertically movable relative to the fixed side walls 22, and as shown in FIG. 2 the output end of lower wall 21 is supported above the input end so that the lower wall is positioned in an inclined orientation. The input end of lower wall 21 is pivotally secured to a receiving platform 26 by a hinge 24, to permit adjustably positioning the output end of the chute between a lowered position whereby the lower wall 21 is disposed in a horizontal orientation and an elevated position with the lower wall 21 disposed at an incline with respect to the floor. Adjustable support means, illustrated herein in the form of a pair of electrically operated jacks 25 cooperates with the output end of lower wall 21 for raising or lowering the same.

Adjoining the elongate pivotally mounted lower wall 21 at the input end of the chute is a horizontally oriented supplemental lower wall, which may be referred to as a receiving platform 26, and which serves as a receiving area for loading of fresh fiber bales into the input end of the chute and also for supporting several reserve bales to be advanced onto lower wall to replace bales which have been consumed by the plucking drum 42.

Initial Loading

To facilitate initially loading the empty chute with fiber bales, the lower wall 21 is preferably oriented in the lowered horizontal position as illustrated in FIG. 10. At least one and preferably several fiber bales B are positioned adjacent the input end of the chute on receiving platform 26 and the pusher plate 31 is then lowered into position and operated to push the bales into the chute and onto lower wall 21. The pusher plate 31 is then retracted and raised and additional bales B are positioned at the input end of the chute receiving platform 26. The pusher plate 31 is again lowered and operated to push these bales, as well as the previously positioned bales, into the chute. This is repeated as many times as needed to fill the chute with fiber bales.

Once the chute is filled with bales, the output end of the lower wall 21 is slowly raised by actuating the jacks 25. As shown in FIG. 11, the drum 42 is operated simultaneously with raising the lower wall 21 of the chute so that the drum removes the fibers from the upper surfaces of those bales which are moved upwardly into its path of travel. As the output end of the lower wall 21 continues to move upwardly, as shown in FIG. 11, it will be seen that the removal of fibers from the bales by drum 42 maintains the upper surface of the bales in a horizontal plane even though the chute begins to assume an inclined orientation. Thus, more fibers are removed from the bales located adjacent the raised discharge end of the chute than from the bales located adjacent the input end thereof. Ultimately, when the chute reaches its fully raised inclined position, the bales along the chute will be of gradually decreasing height from the input end to the output end of the chute. During the time that the chute is being raised from the lowered horizontal position to the raised inclined position, the pusher plate 31 is preferably maintained stationary.

Continuous Operation

After the lower wall 21 has reached its fully elevated inclined position, the pusher plate 31 may be retracted and raised to permit positioning at least one and preferably several reserve bales on receiving platform 26 at the input end of the chute. In the embodiment illustrated in the drawings, the receiving platform 26 at the input end of the chute is of a size adapted to accommodate three bales in reserve. By providing a reserve supply of fresh bales at the input end of the chute, the bale opening apparatus of this invention may be operated for extended periods of time without requiring reloading. Thus, for example, with the bale opening apparatus operating at a rate of about 1500 pounds per hour, an attendant would reload three fresh bales about every hour.

After the reserve bales have been loaded onto receiving platform 26, the pusher plate 31 may again be lowered and operated to slowly push the endmost bale, and thereby advance it and each succeeding bale in the chute along the incline. This slowly raises the upper surfaces of the bales and thereby maintains the same in engagement with the drum 42 as fibers are removed from the bales. As the bales are advanced along the chute, the small residual portions of the bales remaining in the chute fall from the discharge end of the chute and are deposited in the extended apron conveyor 47. When the pusher plate 31 reaches its fully extended position within the chute, and the three reserve bales have thus been consumed, the pusher plate 31 is again moved outwardly to the input end of the chute and raised so that additional fresh fiber bales may be loaded onto the chute as is shown in FIG. 13 for example.

End of Continuous Operation

Figure 14:
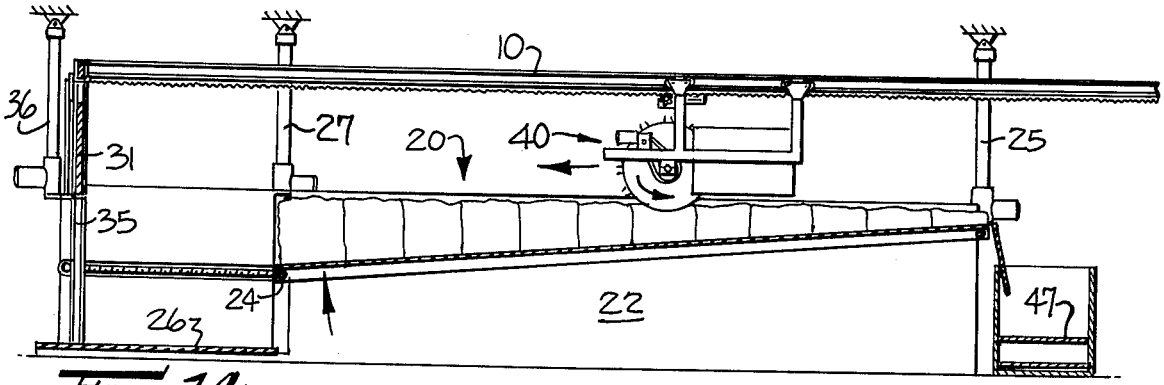
FIG. 14 is a side view similar to FIG. 13 but showing a second embodiment of the invention wherein both the output and the input ends of the lower wall of the chute may be raised, and illustrating the input end being raised during operation of the bale plucking drum to enable the drum to reach the residual portions of the bales remaining in the chute.

In some instances it is necessary or desirable to use the portions of the bales which lie below the plane of movement of the fiber removing device. Typically, this would occur after the last bale of a particular lot of bales has been loaded onto the chute, and it is desired to completely consume these bales prior to loading the chute with fiber bales of a different lot or fiber type. In order to enable the fiber removing device to reach these residual portions of the bales, the chute may be provided with additional adjustable support means adjacent the input end of the lower wall 21. Thus as illustrated in FIG. 14, in accordance with an alternate embodiment of the invention, adjustable jacks 27 may be provided cooperating with the input end of the lower wall 21, in addition to the jacks 25 at the output end. These jacks 27 may be operated as shown in FIG. 14 to slowly raise the input end of the lower wall 21 while the drum 42 continues to move in a reciprocating manner along the row of bales removing fibers therefrom. Thus the lower wall 21 is repositioned from the inclined orientation as shown in FIG. 11 to an elevated horizontal orientation.

Figure 15:
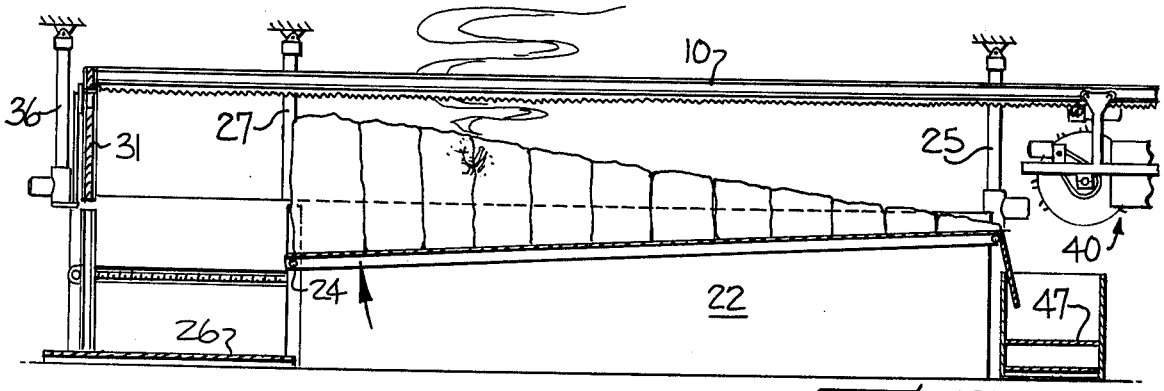
FIG. 15 is a side view similar to FIG. 14 but showing the input end of the lower wall of the chute being raised to facilitate removal of one or more bales from the chute in the event of a fire.

The provision of adjustable support means at both ends of the lower wall 21 provides an additional safety feature. In the event of a fire occurring in one of the bales in the chute, the lower wall 21 may be raised, as illustrated in FIG. 15, to position the bales above the uppermost portions of the side walls 22 so that the smouldering bale may be removed from the chute, and the fire extinguished.

Batchwise Operation

In some circumstances it may be desired to present single bales or very small groups or lots of bales to the fiber removing device. This may be readily accomplished using the form of the invention shown in FIGS. 14 and 15. The chute 20 is loaded with bales in the manner previously outlined with the lower wall 21 being positioned in the lowered horizontal orientation as illustrated in FIG. 10. Once the desired number of bales have been loaded onto the lower wall 21, the jacks 25 and 27 at the input and output ends of the lower wall are both actuated simultaneously so that both ends of the chute are raised at a relatively slow rate of speed while maintaining a horizontal orientation. The drum 42 is also operated to remove fibers from the surfaces of the bales.

Figure 16:
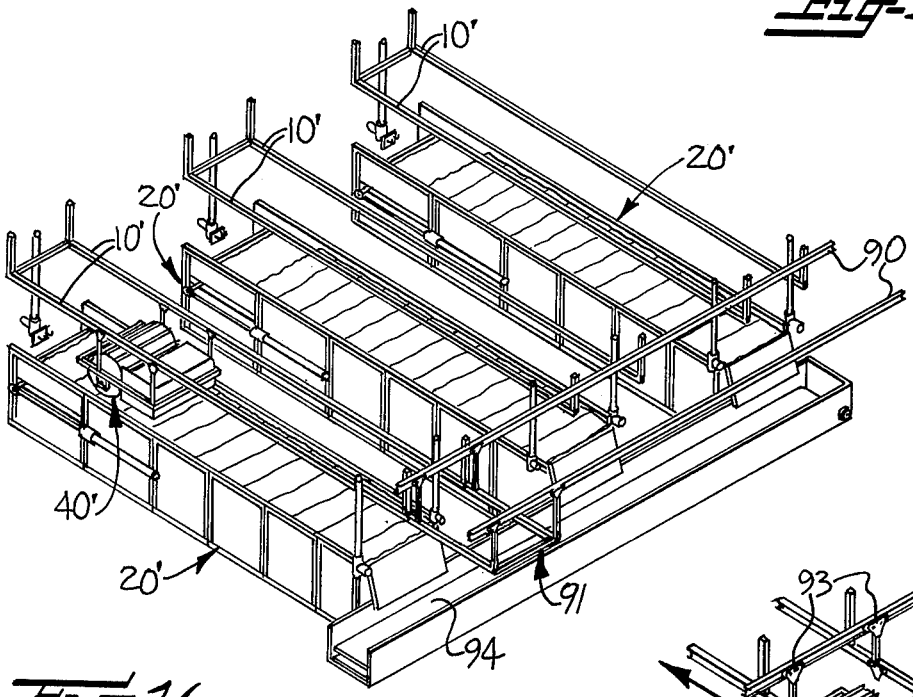
FIG. 16 is a perspective view showing another embodiment of the invention wherein the bale plucking drum and fiber collection hopper are mounted for movement laterally from one row of fiber bales to another row of bales to enable the drum and the fiber collection hopper to serve more than one row of fiber bales.
Figure 17:
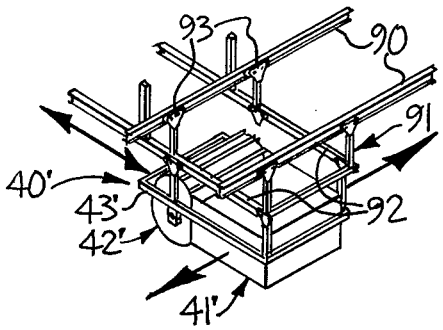
FIG. 17 is a perspective detailed view showing the means employed in FIG. 16 for laterally moving the drum and fiber collection hopper from one row of bales to another.

The modified form of the invention shown in FIGS. 16 and 17 is quite similar to the form previously described with reference to FIGS. 1 to 15. Accordingly, to avoid repetitive description, those parts shown in FIGS. 16 and 17 which correspond to similar parts shown in FIGS. 1 to 15 and previously described in detail, will bear the same reference characters with prime notation added where applicable. Essentially, the modified form of the invention differs from the first form in that the fiber removing device and fiber collection hopper may be used in conjunction with a plurality of rows of fiber bales instead of a single row.

In certain circumstances, one may wish to obtain a blend of fibers from a greater number of bales than can be accommodated on a single chute 20 of the type illustrated. In accordance with this form of the invention, a plurality of rows of fiber bales are supported on respective parallel chutes 20', and the trackway means is constructed in such a manner as to permit shifting the fiber removing device and fiber collection hopper from a position overlying one chute to a position overlying another chute so that a single fiber removing device can be used to service several rows of fiber bales. The construction details of the trackway means may vary depending upon the design of the building in which it is installed. For example, a construction such as that illustrated in FIG. 16 may be employed. In accordance with this arrangement, the trackway means includes respective individual trackways fixedly mounted above each of the chutes 20', each trackway being defined by a pair of parallel I-beams 10' of the type previously described. An additional pair of elongate elevated I-beams 90 extend alongside one end of the respective beams 10'. Mounted for movement along this pair of beams is a carriage 91 (FIG. 17) which includes a pair of beams 92 of similar configuration and spacing to the beams 10' and mounted to the overlying beams 90 by wheel assemblies 93. The carriage 91 is thus mounted for lateral movement perpendicular to the individual trackways along one end thereof and is adapted for receiving the carriage 43', with the drum 42' and hopper 41', from one of the trackways and for transferring the same to another of the trackways.

In operation, the drum 42' and hopper 41' repeatedly move along one of the row of bales while removing the fibers from the bales in that row and while collecting the fibers in the fiber collection hopper 41'. Periodically, the drum 42' and hopper 41' return to a position at one end of the row of bales overlying an elongate fiber receptacle in the form of a conveyor 94 extending alongside the output ends of each of the chutes 20'. The hopper 41' is then opened and the fibers therein are deposited into the conveyor 94. The drum 42' and fiber collection hopper 41' may then be shifted to a position adjacent to and overlying one of the other chutes 20' and the drum 42' and hopper 41' are traversed along that row of bales to remove fibers therefrom. By this arrangement a single plucking drum and fiber receiving hopper can be used to service a large number of rows of fiber bales.

Figure 18:
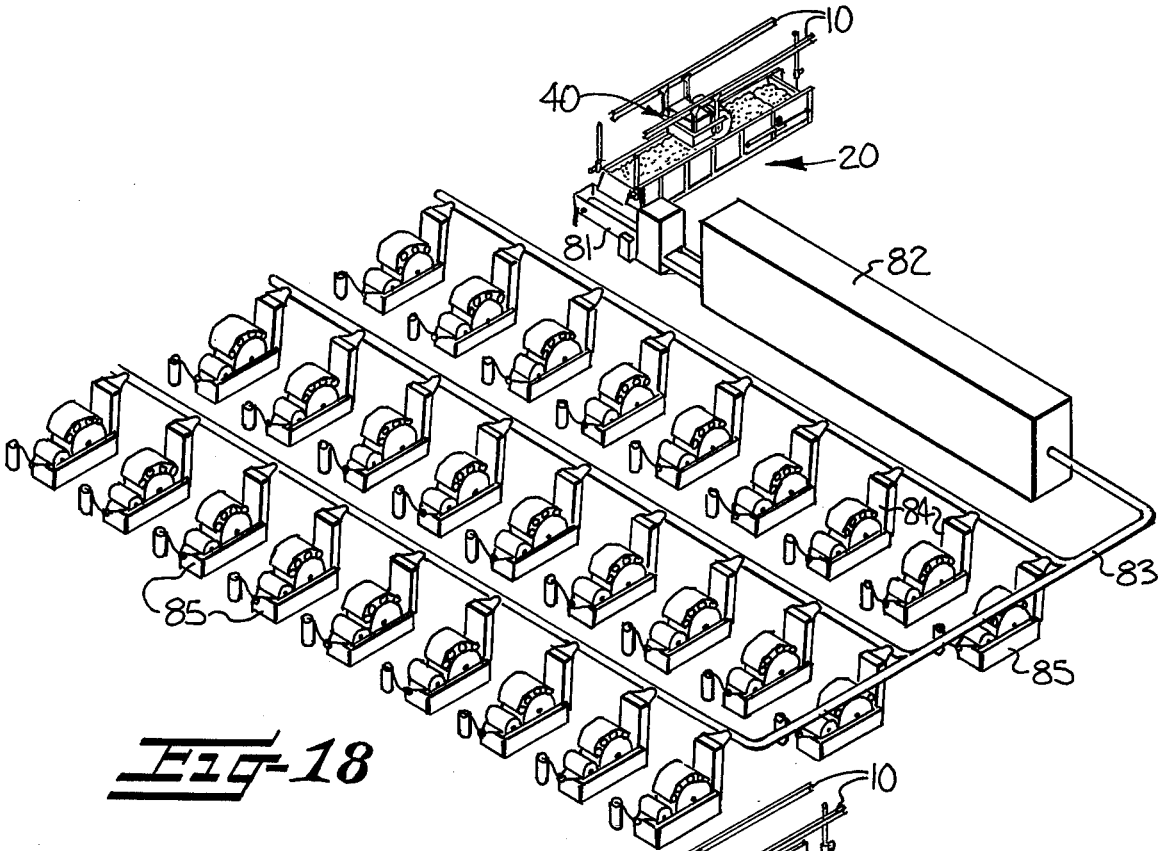
FIG. 18 is a perspective view showing an installation wherein a bank of cards is supplied with fibrous material directly from a bale opening device in accordance with the invention.

FIG. 18 shows one typical arrangement in which a bale opening and blending machine in accordance with this invention can be used for supplying fibrous material to a bank of cards. As illustrated, the bale opening and blending machine, which is of the type previously described in detail with reference to FIGS. 1 to 15 and includes a fiber removing device 40 and a chute 20, delivers fibrous material to fiber cleaning machine 81. The fibrous output of the cleaning machine 81 is pneumatically conveyed to additional cleaning and opening equipment schematically indicated at 82, which may be of any suitable type. From the cleaning and opening equipment 82 the fibrous material is conveyed by a pneumatic fiber distribution system 83 and to respective chute feeds 84 of a plurality of carding machines 85. While a single bale opening and blending machine is illustrated, it will be understood that two or more machines may be used in some installations, depending upon the number and rate of production of the carding machines used. In any event, it will be readily appreciated that the floor space required for one or more of the bale opening and blending machines of this invention in considerably less than the floor space required for a conventional bale opening line of comparable capacity, wherein a plurality of blending feeders are employed with a plurality of bales arranged behind each blending feeder.

Figure 19:
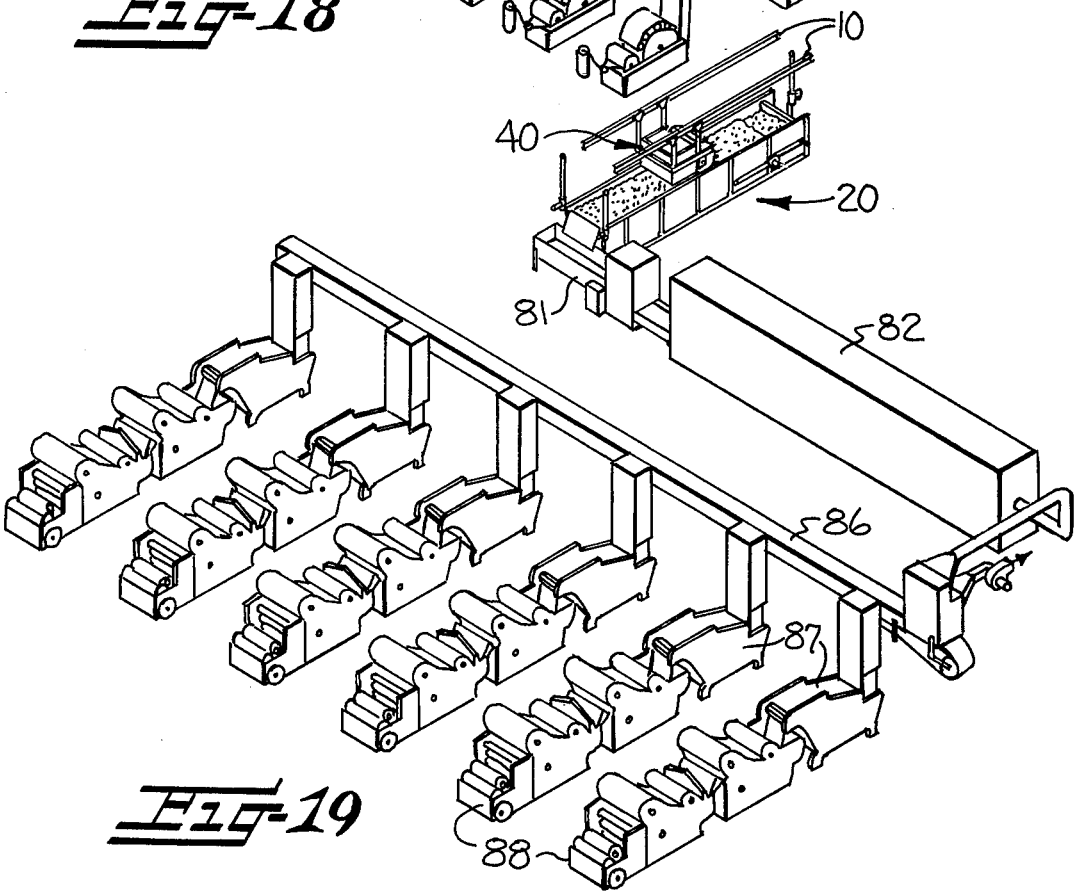
FIG. 19 is a perspective view showing an installation wherein a series of pickers is supplied with fibrous material directly from a bale opening device in accordance with this invention.

FIG. 19 shows an arrangement similar to that of FIG. 18 but wherein the bale opening and blending machine is used to supply fibers to a series of pickers. As illustrated, the fibrous material is pneumatically conveyed from the cleaning and opening equipment 82 to a suitable conveyor-type distribution system 86, serving the respective hoppers 87 of a series of pickers 88.

In the drawings and specifications there have been set forth preferred embodiments of the invention, and although specific terms are employed, they are used in a generic and descriptive sense only and not for purposes of limitation.

That which is claimed is:

1. A method of removing and blending fibers from a plurality of fiber bales, said method comprising positioning a predetermined number of fiber bales in a row in abutting relation on a horizontally oriented elongate support having an input end and an output end, slowly moving the output end of the elongate support upwardly to move and reposition the support from the horizontal orientation to a predetermined inclined orientation while repeatedly moving a fiber removing device in a predetermined substantially horizontal path of travel along the row of bales while engaging uppermost portions of the bales with the fiber removing device and removing fibers from the bales to thereby maintain the upper surface of the bales lying substantially in the horizontal path of travel, repeatedly moving the fiber removing device and removing fibers from the bales after the bale support has reached the predetermined inclined orientation, while engaging the endmost fiber bale at the input end of the now inclined bale support and pushing such endmost bale up the inclined support to thereby advance the entire row of bales along the support toward the output end and to also cause the upper surfaces of the respective fiber bales to be moved upwardly closer to the fiber removing device, and periodically positioning at least one fresh fiber bale at the input end of the bale support and pushing such bale toward and into engagement with the next adjacent fiber bale on the bale support to thereby replenish the supply of fiber bales on the bale support.

2. The method according to claim 1 wherein the step of positioning a predetermined number of fiber bales on the horizontally oriented elongate support comprises positioning at least one fiber bale at the input end of the support and pushing the same along the support toward the output end for a predetermined distance, positioning at least one additional fiber bale at the input end of the support and pushing the same along the support toward the output end and into engagement with the previously positioned bales while causing such previously positioned bales to also be pushed along the support and while guiding the bales along a predetermined path to arrange the bales in a row on the support, and repeating the previous step as many additional times as necessary to position the desired predetermined number of bales on the bale support.

3. The method according to claim 1 including the further step, performed simultaneously with movement of the fiber removing device along the row of bales and removal of fibers therefrom, of slowly raising the lower end of the elongate support so as to reposition the support from an inclined orientation to an elevated horizontal orientation to thereby bring all of the bales closer to the fiber removing device and facilitate disposal of the remaining portions of the bales positioned on the support.

4. An apparatus for removing and blending fibers from a series of fiber bales arranged in a row, said apparatus comprising elongate bale support means adapted for supporting the series of bales in consecutively arranged abutting relation;

an elongate trackway extending along and adjacent to said elongate bale support means;

a carriage mounted for translational movement along said trackway adjacent to said bale support means and to the respective bales thereon;

a cylindrical drum supported by said carriage and overlying said bale support means and the respective bales thereon and mounted for rotational movement about a horizontal axis transverse to the direction of translational movement of said carriage;

a plurality of pluckers extending across the width of said drum at circumferentially spaced locations around the periphery thereof;

means for effecting rotational movement of said drum and simultaneous translational movement of said carriage along said trackway so as to bring said pluckers into engagement with uppermost portions of the respective bales at spaced apart locations on the bales as the respective pluckers reach the lowermost position during rotation of said drum;

means cooperating with said pluckers to open and close the same in timed relation with the rotational movement of said drum for grasping bunches of fibers from the bales and subsequently releasing the bunches of fibers; and means provided adjacent to said drum for receiving the bunches of fibers released by said pluckers.

5. The apparatus according to claim 4 wherein said plurality of pluckers comprises a plurality of sets of relatively short cooperating pairs of bar segments arranged end-to-end across the axial extent of said drum at circumferentially spaced locations around the drum, and wherein said means cooperating with said pluckers to open and close the same comprises means cooperating with the respective sets of bar segments for moving the same in said drum between a radially extended position with the cooperating pairs of bar segments in a set being spread apart from one another and adapted to receive fibers therebetween, and to a radially retracted position with the cooperating pairs of bar segments in the set being closed and adapted to graspingly retain the fibers therebetween.

6. The apparatus according to claim 4 wherein said elongate bale support means comprises an elongate chute disposed at an incline with respect to said trackway and being of a length sufficient for accommodating a plurality of successively arranged fiber bales therein, and means associated with said inclined chute for engaging the endmost fiber bale at the lowermost end of the chute and pushing the bale along the chute to thereby advance all of the bales in the chute up the incline and maintain the upper surfaces thereof in position for engagement by said pluckers.

7. The apparatus according to claim 6 wherein said elongate chute comprises a generally planar inclined lower wall adapted for supporting thereon a row of fiber bales with each bale arranged with the fiber layers thereof extending lengthwise of the row of bales and oriented in a vertical plane, and said chute also having opposing side walls extending along opposite sides of the lower wall and serving to confine the row of bales in the chute while limiting widthwise expansion of the bales.

8. The apparatus according to claim 7 wherein uppermost portions of the opposing side walls of the chute extend above the upper surfaces of the fiber bales in the chute, with lowermost portions of said cylindrical drum being received therebetween.

9. The apparatus according to claim 4 wherein said means for receiving bunches of fibers released by said pluckers comprises a fiber collection hopper supported by said carriage for movement with said cylindrical drum and positioned for receiving the bunches of fibers released by said pluckers, said fiber collection hopper having movable door means in a lower portion thereof adapted to permit periodically discharging the collected fibers from the hopper.

10. An apparatus for removing and blending fibers from a series of fiber bales arranged in a row, said apparatus comprising an elongate elevated trackway extending along and above the row of bales, a carriage mounted for movement along said trackway above the row of bales, a fiber removing device mounted on said carriage and adapted for movement therewith along the row of bales and having means positioned to engage uppermost portions of the bales and to remove fibers therefrom during movement of the fiber removing device along the row of bales, a fiber collection hopper operably associated with said fiber removing device and mounted on said carriage for movement therewith along the row of bales for receiving and collecting fibers removed from the bales by said fiber removing device, said fiber removing device comprising a rotatable plucking means carried by said carriage and mounted for rotational movement thereon and including a circularly arranged series of radially extending jaws at spaced locations thereabout, the jaws being adapted to be successively brought into engagement with uppermost portions of the bales during rotation of the plucking means, and said plucking means including means for opening and closing the respective jaws in timed relation with the rotational movement of the plucking means to grasp bunches of fibers from the bales at longitudinally spaced apart locations on the respective bales and thereafter deposit the bunches of fibers into said fiber collection hopper, and wherein said circularly arranged series of jaws comprises cooperating pairs of elongate bars extending parallel to the rotational axis of the plucking means, and wherein the plucking means includes a cylindrical drum having segmental wall portions extending between the respective cooperating pairs of elongate bars and so positioned for engagement with the uppermost portions of the bales during rotational and translational movement of the drum relative to the bales, and means operably associated with said hopper for periodically emptying the mass of collected fibers from the hopper.

11. The apparatus according to claim 10 wherein said cooperating pairs of elongate bars are each mounted for radial movement in said cylindrical drum between a retracted position substantially flush with the segmental wall portions of said drum and an extended position protruding radially outwardly from the segmental wall portions of said drum, and wherein said means cooperating with said bars for opening and closing the same is also operable for moving said bars between said retracted position and said extended position in timed relation with the rotational movement of said drum.

12. The apparatus according to claim 10 wherein said cooperating pairs of elongate bars are each comprised of sets of relatively short cooperating pairs of bar segments arranged in a row end-to-end across the axial extent of said drum, the end-to-end pairs of bar segments in each row being mounted for simultaneous movement radially inwardly and outwardly for grasping bunches of fibers therebetween, and each cooperating pair of bar segments being independently biased toward one another so as to independently grasp bunches of fibers and insure a more uniform removal of fibers across the bales.

* * * * *